United States Patent [19]

Kluga

[11] Patent Number: 4,858,322

[45] Date of Patent: Aug. 22, 1989

[54] CIRCLE CUTTER EMPLOYING BASE, SWIVEL HANDLE, AND PIVOT BAR WITH ADJUSTABLE KNIFE

[76] Inventor: Benjamin Kluga, 26295 Wilson St., Los Molinos, Calif. 96055

[21] Appl. No.: 154,980

[22] Filed: Feb. 9, 1988

[51] Int. Cl.[4] ..... B26B 3/00

[52] U.S. Cl. ..... 30/310; 30/164.9

[58] Field of Search ..... 30/310, 164.9, 300; 33/27.03

[56] References Cited

U.S. PATENT DOCUMENTS

| | | | |
|---|---|---|---|
| 2,463,024 | 3/1947 | Del Monte | 30/310 |
| 2,754,586 | 7/1956 | Manstorp | 30/310 |
| 3,456,346 | 7/1969 | Snyder | 30/151 |
| 4,044,464 | 8/1977 | Schiess et al. | 30/310 |

*Primary Examiner*—Donald R. Schran
*Assistant Examiner*—Willmon Fridie, Jr.
*Attorney, Agent, or Firm*—David Pressman; H. K. Saalbach

[57] ABSTRACT

An improved circle cutting tool for performing circular cuts on a wide variety of materials. Comprises a body (10) having a horizontal rotating radius bar (18) which is provided with an adjustable knife holder (20) and knife blade (30). The knife holder may be reversed for right or left handed users. The body is also provided with anchor pins (12) on the bottom and a swivel handle (38) on top.

5 Claims, 2 Drawing Sheets

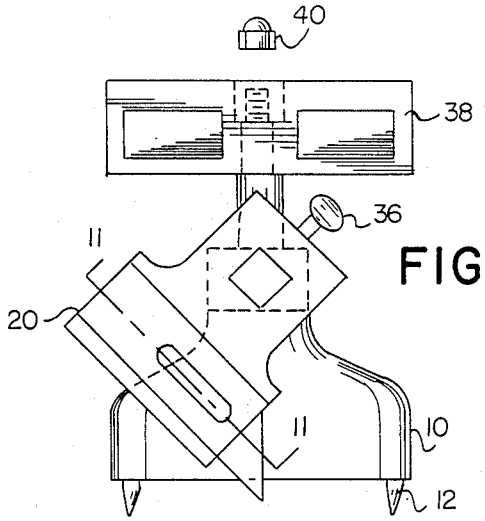
FIG. 2
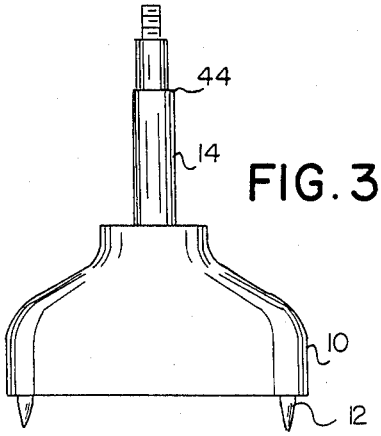
FIG. 3
FIG. 4
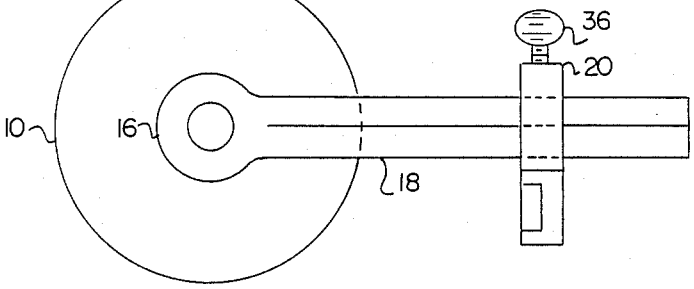
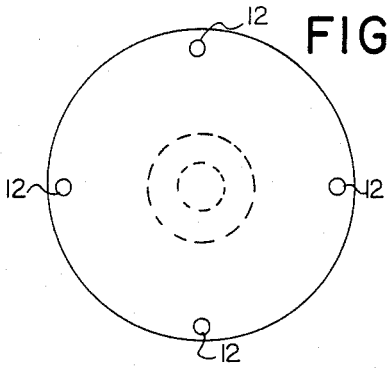
FIG. 5
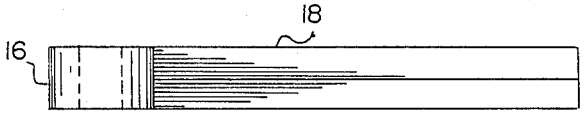
FIG. 6
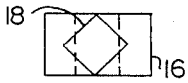
FIG. 7
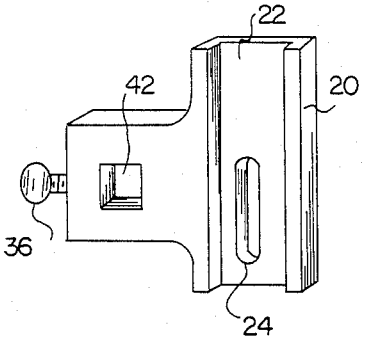
FIG. 8
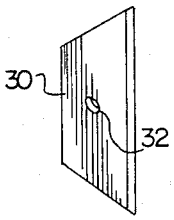
FIG. 9
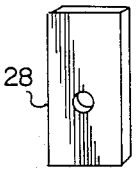
FIG. 10
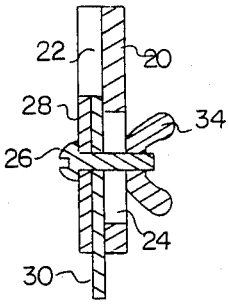
FIG. 11

CIRCLE CUTTER EMPLOYING BASE, SWIVEL HANDLE, AND PIVOT BAR WITH ADJUSTABLE KNIFE

BACKGROUND

1. FIELD OF INVENTION

This invention relates to circle cutting devices that facilitate the cutting of precise circular portions from a wide variety of materials. 2. Description of Prior Art Heretofore circle cutting devices, used in the repair of carpets, were regarded by their users as unsatisfactory because their use was limited to cutting a circle of one size, such as the circle cutter's in U.S. Pat. No. 3,456,346 to Snyder, July 22, 1967. Most users therefore, would find it desirable to have a circle cutter that would provide for cutting circular parts in a wide variety of sizes.

OBJECTS AND ADVANTAGES

Accordingly I claim the following as objects and advantages of the invention: To provide a circle cutter for easily and reliably cutting circular portion in a variety of sizes from carpeting or other suitable material, to provide a circle cutter which requires a minimum of skill and training to use, and to provide a tool which can do a complete job in one operation.

In addition I claim the following additional objects and advantages: To provide a circle cutter which can cut material of a compact nature, such as linoleum, in addition to material of a loosely knit structure, such as carpeting and to provide such a tool which can be adjusted to cut a variety of thicknesses.

Readers will find further objects and advantages of the invention from a consideration of the ensuing description and accompanying drawings.

DRAWING FIGURES

FIG. 2 shows a side elevation view of the circle cutter showing the position of the square radius bar in relation to the vertical axis of the circle cutter.

FIG. 3 shows a side elevation view of a circle cutters stepped vertical shaft which provides for the height adjustment of the radius bar and seat for the swivel handle.

FIG. 4 shows a top plan view of the circle cutter.

FIG. 5 shows a bottom plan view of the circle cutter showing the body's pins.

FIG. 6 shows a side elevation view of the circle cutters radius bar and bearing.

FIG. 7 shows a front elevation view of the circle cutters radius bar and bearing.

FIG. 8 shows a side elevation view of the circle cutters knife holder.

FIG. 9 shows an elevation view of the knife blade as used in the invention.

FIG. 10 shows an elevation view of clamp used to secure knife blade in holder.

FIG. 11 shows a detail sectional view taken along the lines 11—11 of FIG. 2.

Similar numerals refer to similar parts throughout the several views.

DRAWING REFERENCE NUMERALS

Figure 1:
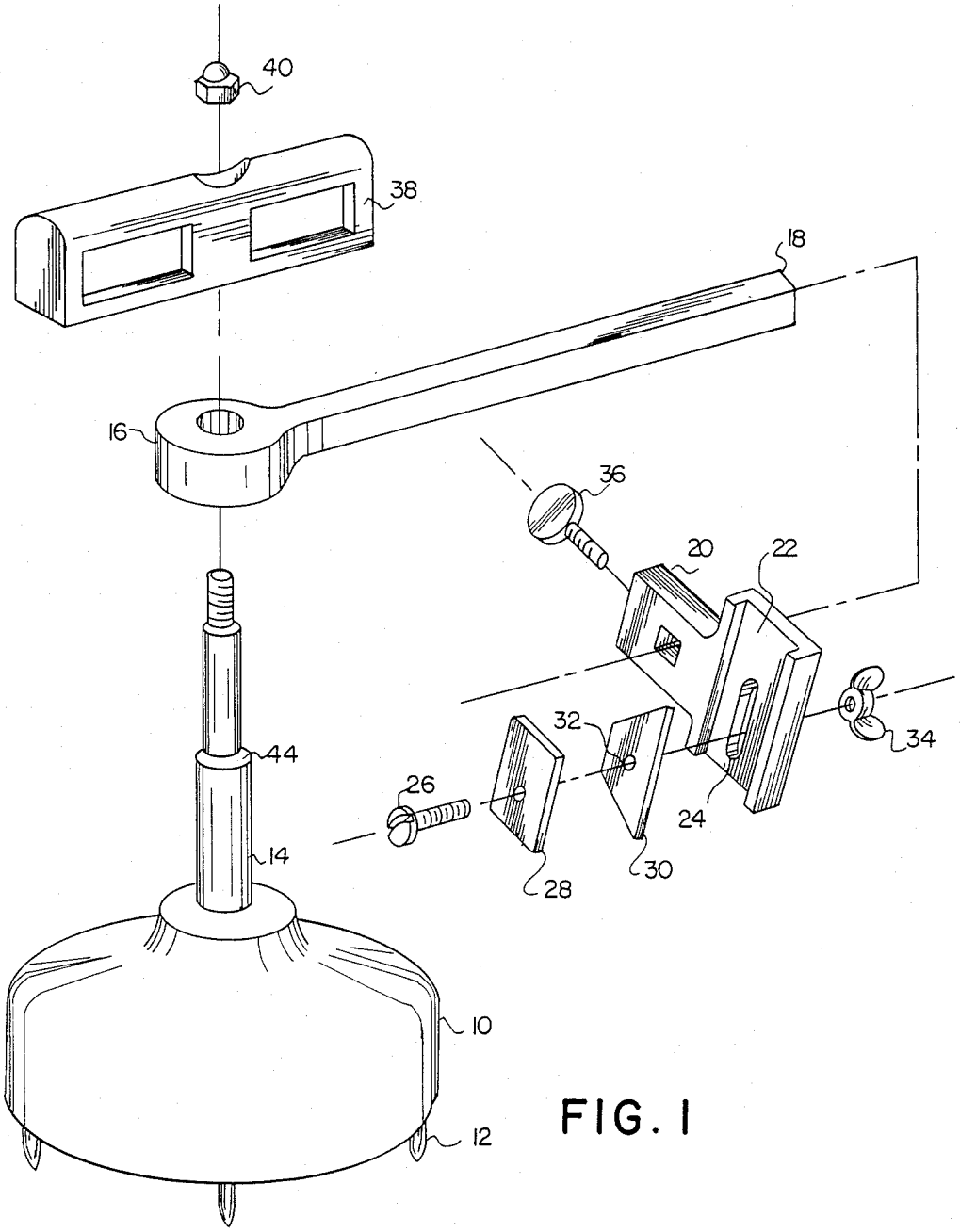
FIG. 1 shows an exploded elevational view showing all a components of my circle cutter as they are related to each other.

10: body
12: pins
14: verticle stepped shaft
16: bearing
18: radius bar
20: knife blade holder
22: knife blade recess
24: screw slot
26: screw
28: clamp plate
30: knife blade
32: knife blade hole
34: wing nut
36: thumb screw
38: swivel handle
40: cap nut
42: square hole
44: stop.

ADJUSTABLE TOOL—DESCRIPTION

FIG. 1 shows the circle cutting tool according to the preferred embodiment of the invention. The circle cutter comprises a main body portion 10 which itself comprises a verticle stepped shaft 14. The verticle stepped shaft 14 provides a means for pivoting a bearing 16 attached to a end of radius bar 18. This arrangement provides a means for sliding the knife blade holder 20 horizontally along the length of a radius bar 18 best shown in FIG. 4. The knife blade holder 20 is provided with a recess 22 sufficiently deep to accept both knife blade 30 and clamp plate 38 best shown in FIG. 1 the clamping action being provided by the through arrangement of screw 26 knife blade hole 32 screw slot 24 and wing nut 34. When the wing nut 34 is loosened the knife blade 30 is permitted to slide within the limits of the screw slot 24. In this way there is provided a fully extended cutting mode or a fully retracted safety mode. The knife blade holder 20 is further provided with a thumb screw 36 which provides a means for locking the knife blade holder 20 in any place along the horizontal radius bar 18. The corners of the square radius bar 18 are so placed that two opposite corners are in verticle alignment with the circle cutters vertical stepped shaft 14 best shown in FIG. 2. Therefore when the knife blade holder 20 which has a square hole 32 is placed anywhere along the square radius bar 18 the verticle alignment serves the purpose of locating the point of entry of the knife blade 30 precisely on the arc of whichever size circle is being cut. The tool is further equipped with a swivel handle 38 which swivels on the stop 44 provided by the stepped portion of the vertical shaft 14 and is held in place by a cap nut 32.

ADJUSTABLE CIRCLE CUTTER—OPERATION

The use of the circle cutter in connection with making quick repairs to carpets damaged in some indelible way, such as ink, bleach, cigarette burns etc., is as follows:

The user would first center the tool in the damaged area of the carpet, loosen thumb screw 36 on knife holder 20 and slide the knife holder along the holizontal radius bar 18 till the appropriate sized patch is determined, tighten said thumb screw, thus locking knife holder in position. Then loosen wing nut 34 on knife holder 20 thus allowing knife blade 30 to drop in its recess and into cutting position.

By placing a hand upon the radius bar, sufficient pressure is brought to bear upon the bearing 16 to cause the radius bar to lower itself on the verticle shaft 14 and thereby engage the knife blade into the carpet.

With one hand excerting downward pressure on the swivel handle 38, thus anchoring the tool into the carpet by means of the sharpened pin 12, the other hand is used to rotate the radius bar in a complete circle whereby an accurate patch is cut out of the damaged carpet.

The same described procedure is repeated, without changing any settings, in an obscure area of the same carpet, such as a closet, and the resulting patches exchanged, thus making an invisable repair in a highly visable area of the carpet. The knife holder may also be reversed on the radius bar thus rendering the tool for use by either a right or left handed operator.

While the above description contains specificities, the reader should not construe these as limitations on the scope of the invention, but merely as exemplifications of preferred embodiments thereof.

Those skilled in the art will envision that many other possible variations are within its scope. For example, skilled artisans will readily be able to change the dimensions and shapes of the various embodiments. They will also be able to make the cutter of alternative materials, such as plastic and wood. They can make many variations on the adjustment mechanism of FIG. 1 e.g., they can make the radius bar in the shape of a rectangle or a keyed round. They can make the knife holder in a way to hole a plurality of knives to make multiple cuts. They could alter the pins (as in FIG. 1) to other means of anchoring the tool, as required to cut the material on hand, such as rubber suction cups or magnetic elements. Accordingly the reader is requested to determine the scope of the invention by the appended claims and their legal equivalents, and not by the examples given.

I claim:

1. A circle cutter for making a circular cut of a selectable diameter in a rug or other soft, cuttable material, comprising:

a body portion having a bottom surface with a plurality of spaced prongs extending downward therefrom, said bottom surface and prongs adapted for non-slidingly resting on a selected portion of said material, and having a top surface with a shaft extending upwardly therefrom, said shaft being fixed to said body portion and having a stepped configuration including a lower cylindrical portion having a larger diameter, an upper cylindrical portion having a smaller diameter and an upwardly facing shoulder therebetween, said top surface, said bottom surface and said prongs being symmetrically oriented with respect to the axis of said shaft, a manually-graspable handle pivotably positioned at the top of said shaft for rotation about said shaft with the lower face of said handle in bearing relationship to said upwardly facing shoulder, said handle being swivelable with respect to said shaft about an axis which is symmetrically oriented with respect to said base and said prongs, a horizontal radius arm pivotably and slideably positioned on said lower portion of said shaft and having a free end at one end thereof and a pivot portion at the other end thereof, said pivot portion being positioned on said shaft so that said pivot portion engages said top surface of said body portion when the arm is slid to its lowest position and engages said lower face of said handle when the arm is slid to its highest position, said pivot portion being arranged to allow said arm to swing in a circular horizontal arc about said shaft, a knife holder mounted on said arm, said knife holder including means for fixing said knife holder at any position on said arm between said pivot portion and said free end of said arm, a knife having a blade having a sharpened, straight forward edge with a point at one end of said edge, said knife holder also including means for holding said knife so that said straight, sharpened edge thereof will be inclined at an angle to flat surface on which said body portion is positioned, said knife holder including knife adjustment means for adjusting the position of said knife with respect to said flat surface so that, when said arm is slid to its lowest position and said pivot portion engages said top surface of said body portion, said knife can make cuts in said flat surface of a fixed depth and, when said arm is slid to higher positions, said knife can make cuts in said flat surface of a range of lesser depths without changing the angle of said straight, sharpened edge thereof with respect to said flat surface, whereby when said arm is moved in said arc, said knife will be able to cut material of a wide range of thicknesses under said cutter smoothly and without buckling, and whereby the user of said circle cutter can support the user's body weight by placing the palm of one hand on said rotatable manually-graspable handle and then continuously grip its, without shifting the grip, as the user swivels about the said circle cutter and manipulates the said knife with the other hand.

2. The circle cutter of claim 1 wherein said radius bar is rectangular in shape.

3. The circle cutter of claim 1 wherein said knife adjustment means comprises a block having a slot into which said knife is positioned.

4. The circle cutter of claim 1 wherein said base comprises a bell-shaped member which has a circular confiruration when seen from the top thereof.

5. The circle cutter of claim 4 wherein said prongs are four in number and are positioned around the edge of said base.

* * * * *